US005310336A

United States Patent [19]

Segawa

[11] Patent Number: 5,310,336

[45] Date of Patent: May 10, 1994

[54] LIGHTER

[76] Inventor: Takaaki Segawa, 3-57-14, Wakamiya, Ichikawa-shi, Chiba-ken, Japan

[21] Appl. No.: 61,551

[22] Filed: May 17, 1993

[30] Foreign Application Priority Data

| | | | |
|---|---|---|---|
| Jul. 17, 1992 | [JP] | Japan | 4-190417 |
| Jul. 17, 1992 | [JP] | Japan | 4-190418 |
| Dec. 4, 1992 | [JP] | Japan | 4-325834 |
| Jan. 5, 1993 | [JP] | Japan | 5-000205 |

[51] Int. Cl.[5] ..... F23Q 2/08

[52] U.S. Cl. ..... 431/131; 431/132; 431/255; 431/277

[58] Field of Search ..... 431/130, 131, 142, 143, 431/150, 255, 276, 277, 132

[56] References Cited

U.S. PATENT DOCUMENTS

| | | | |
|---|---|---|---|
| 2,759,345 | 8/1956 | Peterson | 431/131 |
| 4,466,788 | 8/1984 | Nitta | 431/255 |

FOREIGN PATENT DOCUMENTS 2216244 12/1991 United Kingdom .

*Primary Examiner*—Carroll B. Dority

*Attorney, Agent, or Firm*—Sughrue, Mion, Zinn, Macpeak & Seas

[57] ABSTRACT

A cigarrette gas lighter is disclosed which enables a selection between a substantially clear flame (burning gas) which is windshielded or presents an increased resistance to the wind effect and a red natural flame which can be visually easily recognized, wherein the selection is facilitated. A cylinder member (3, 30) has an air inlet port (30*a*) at its lower end while a mixing tube (8) is formed with an air suction port (8*b*) in its lateral surface. A flame switching tube (7) surrounds the outer periphery of the mixing tube (8), and when it is located at its first position, the flame switching tube (7) closes the air suction port (8*b*) while an open/close member (7*g*) leaves the air inlet opening (30*a*) open. When the flame switching tube (7) is driven to its second position, the flame switching tube (7) opens the air suction port (8*b*) while the open/close member (7*g*) closes the air inlet opening (30*a*).

8 Claims, 7 Drawing Sheets

6
5
4
3
7
17
16
7b
7g
7f
8b
9
8
10c
23
24
26c
20b
10b
10a
12
26d
27
13
14
25
27a
28
29
22
21
19
C3
20
C2
26a
26
C1
26b
FT

LIGHTER

FIELD OF THE INVENTION

The invention relates to a gas lighter, and in particular, to an improvement of a lighter as disclosed in Japanese Utility Model Publication No. 45,017/1991 in which a combustion of a gas/air mixture occurs within a windshielded cylinder.

PRIOR ART

A gas lighter is disclosed in Japanese Utility Model Publication No. 45,017/1991 (corresponding British Patent Application No. 8,904,419.2 or British Patent No. 2,216,244 B; corresponding French Patent Application No. 89-02,394 or French Patent Publication No. 2,627,848; corresponding Korean Patent Application No. 89-2248; and corresponding Taiwan Utility Model Application No. 79,205,084) which comprises a hollow combustion cylinder (3) having an internal space, into which a mixture of a fuel gas and air is supplied for combustion therein. Since the gas is burned inside the cylinder (3), which prevents the gas being burned from being blown off by an external wind, the fire cannot be put out by wind; thus, there is provided a primary windshield effect. In addition, a wire of catalyst (7) is disposed within the combustion cylinder (3) and is red heated by the burning gas. If a strong wind finds its way through a top opening of the combustion cylinder (3) to cause the combustion which is occurring therein to be extinguished momentarily, the heated catalyst wire (7) causes its surrounding mixture gas to be re-ignited automatically. Thus, the catalyst wire (7) which is red heated by the burning gas maintains a continued combustion of the mixture gas which exists therearound, so that any temporary extinction of the fire which may be caused by a strong wind can be immediately and automatically recovered by re-ignition, thus providing an enhanced windshield effect or a secondary windshield effect produced by the catalyst wire (7).

A mixture of a fuel gas and air is supplied to the combustion cylinder (3) through a gas mixing tube (5) having a fuel gas inlet at its lower end, a gas discharge opening at its top end which projects into the combustion cylinder (3), and an air suction port formed in the lateral side and located intermediate the gas inlet and the gas discharge opening. Air is admitted from the suction port at a high rate by virtue of a gas flow, whereby the gas mixing tube (5) is effective to supply a mixture gas to the combustion cylinder (3) at a relatively high rate. Accordingly, a combustion gas is produced at a high rate by the combustion cylinder (3). Unfortunately, because the fuel gas is completely mixed with air, red flame which is normally noted does not appear either inside or outside the combustion cylinder (3), and since the burning gas is either clear or only slightly bluish, the combustion is difficult to recognize. If the catalyst wire (7) is provided, it is red heated, and therefore, it is a simple matter to recognize the ignition if one views the inside of the combustion cylinder (3) from above. However, it is not a simple matter to recognize the presence of an ignited flame when viewing from the lateral side. Inasmuch as the burning gas is being blown out at a high rate, a failure to recognize the burning flame may cause an uneasiness on the part of a user, in particular, when no catalyst wire (7) is provided.

It will be seen that a cigarrette lighter is frequently used in a mild indoor environment as well as in a windy outdoor. During indoor use or outdoor use where the wind is calm, an ordinary red flame such is as produced by a candle light is frequently desired in view of the emotional tranquilness created. Accordingly, it is preferred that a single lighter is capable of selectively producing a windshielded flame (a burning mixture gas) and a visually acceptable red flame, which is of a low windshield effect though.

SUMMARY OF THE INVENTION

The invention has for its first object the provision of a lighter which enables such a selection; for its second object the enhanced ease of operation by a user for such selection, and has for its third object enhancing the reliability of gas ignition for either burning flame being selected.

The invention relates to a lighter including a fuel tank (FT) including a gas discharge valve, a cylinder member (3), a nozzle member (7*d*) projecting into the internal space within the cylinder member (3) from below, a gas guide sleeve (8) for guiding a fuel gas delivered out of the fuel tank (FT) through the gas discharge valve thereof to the nozzle member (7*d*), an air suction inlet (8*b*) formed in the lateral side of the gas guide sleeve (8), and ignition means for igniting a fuel gas which finds its way out of the nozzle member (7*d*) into the cylinder member (3). In accordance with the invention, the lighter further comprises an opening (30*a*) formed in the lower end of the cylinder member (3) for admitting air into the cylinder member (3); a first shutter member (7*h*) slidably is mounted on the gas guide sleeve (8) and movable between a first position in which it closes the air suction port (8*b*) and a second position where it opens the air suction port (8*b*); and a second shutter member (7*g*) connected to the first shutter member (7*h*) and movable between a first position where it opens the opening (30*a*) when the first shutter member (7*h*) moves to its first position and a second position where it closes the opening (30*a*) when the first shutter member (7*h*) moves to its second position.

It is to be noted that numerals and characters appearing in parentheses refer to corresponding elements appearing in an embodiment shown in the drawings and to be described later.

With the lighter according to the invention, when the first shutter member (7*h*) is placed in its first position and the gas discharge valve of the fuel tank (FT) is opened, the fuel gas which is delivered by the fuel tank (FT) passes through the gas guide sleeve (8) and the nozzle member (7*d*), thus finding its way into the cylinder member (3). Upon the ignition of the fuel gas within the cylinder member (3) by means of the ignition means, a flame rises upwardly from the cylinder member (3). Since the air suction port (8*b*) is closed by the first shutter member (7*h*), no substantial amount of air is mixed with the fuel gas which reaches the cylinder member (3) through the gas guide sleeve (8) and the nozzle member (7*d*), but a flow of the fuel gas emitted from the nozzle member (7*d*) causes a suction of air into the cylinder member (3) through the opening (30*a*), whereby the flame which rises from the upper end of the nozzle member (7*d*) is supplied with air from the outside, causing the flame to be a natural flame including a red outer flame just like a candle flame looks like. The flame will be readily extinguished by a lateral wind having a relatively low level of flow velocity, but the presence of the flame is clearly indicated in view of its being a red flame. Such natural flame is suitable for use in putting fire on a cigarrette indoors.

When the first shutter member (7*h*) is placed in its second position and the gas discharge valve of the fuel tank (FT) is opened, the fuel gas from the fuel tank (FT) passes through the gas guide sleeve (8) and the nozzle member (7*d*) to be delivered into the cylinder member (3). Since the air suction port (8*b*) is now open, the gas flow through the cylinder (3) causes a suction of air into the cylinder member (3) to be mixed with the fuel gas, and such mixture gas within the cylinder member (3) is ignited by the ignition means, whereupon the mixture gas is burned within the cylinder member (3) and the burning gas rises upwardly from the cylinder member (3). The mixture gas occupying the internal space of the cylinder member (3) will be burned while it is substantially within the cylinder member (3), and thus cannot be readily extinguished by wind inasmuch as the cylinder member (3) prevents the burning gas from being blown off by external wind. In this manner, there is produced a primary windshield effect.

When a wire of catalyst (4) is disposed within the cylinder member (3), it will be red heated by a burning gas, so that if a strong wind is admitted through an opening at the upper end of the cylinder member (3) to cause a temporary extinction of the burning within the cylinder member (3), the heated wire (4) automatically re-ignites the mixture gas around it. In other words, the catalyst wire (4) which is red heated by the burning gas maintains a continued combustion of the mixture gas which is located therearound, thereby providing an enhanced windshield effect in that any temporary extinction which may be caused by a strong wind can be instantly and automatically followed by a re-ignition, or there is provided a secondary windshield effect by the catalyst wire (4).

Other objects and features of the invention will become apparent from the following description of an embodiment thereof with reference to the drawings.

DESCRIPTION OF PREFERRED EMBODIMENTS

Figure 1:
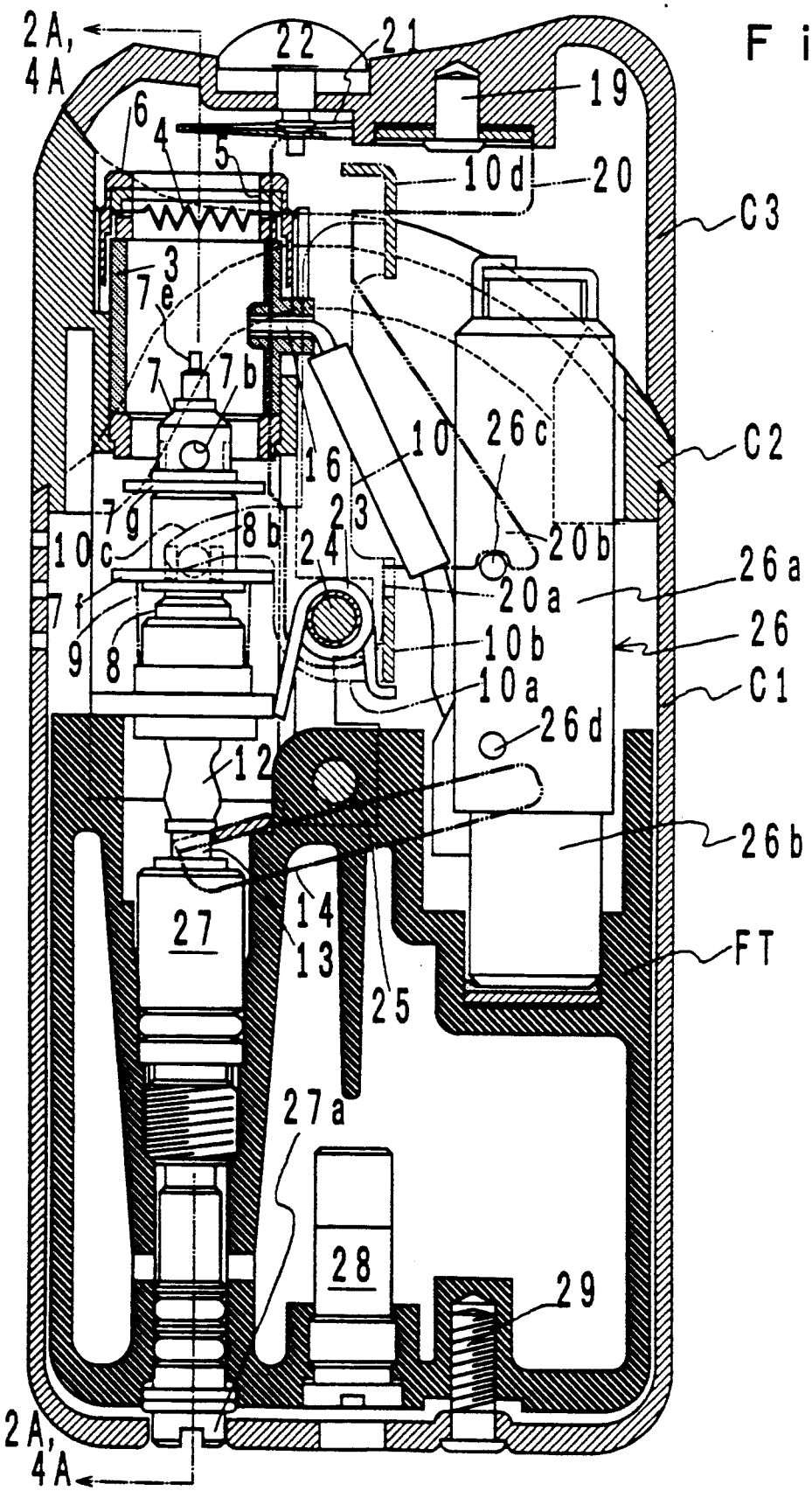
FIG. 1 is a longitudinal section of an embodiment of the invention.
Figure 2:
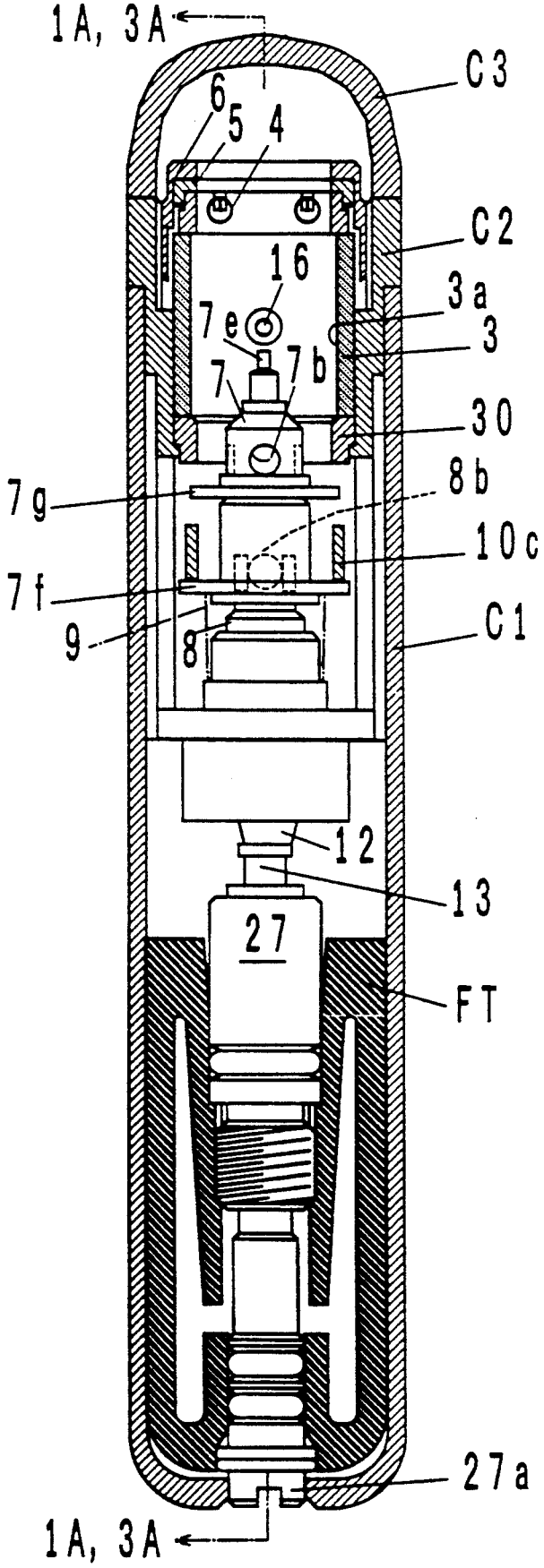
FIG. 2 is a cross section taken along the line 2A—2A shown in FIG. 1.
Figure 3:
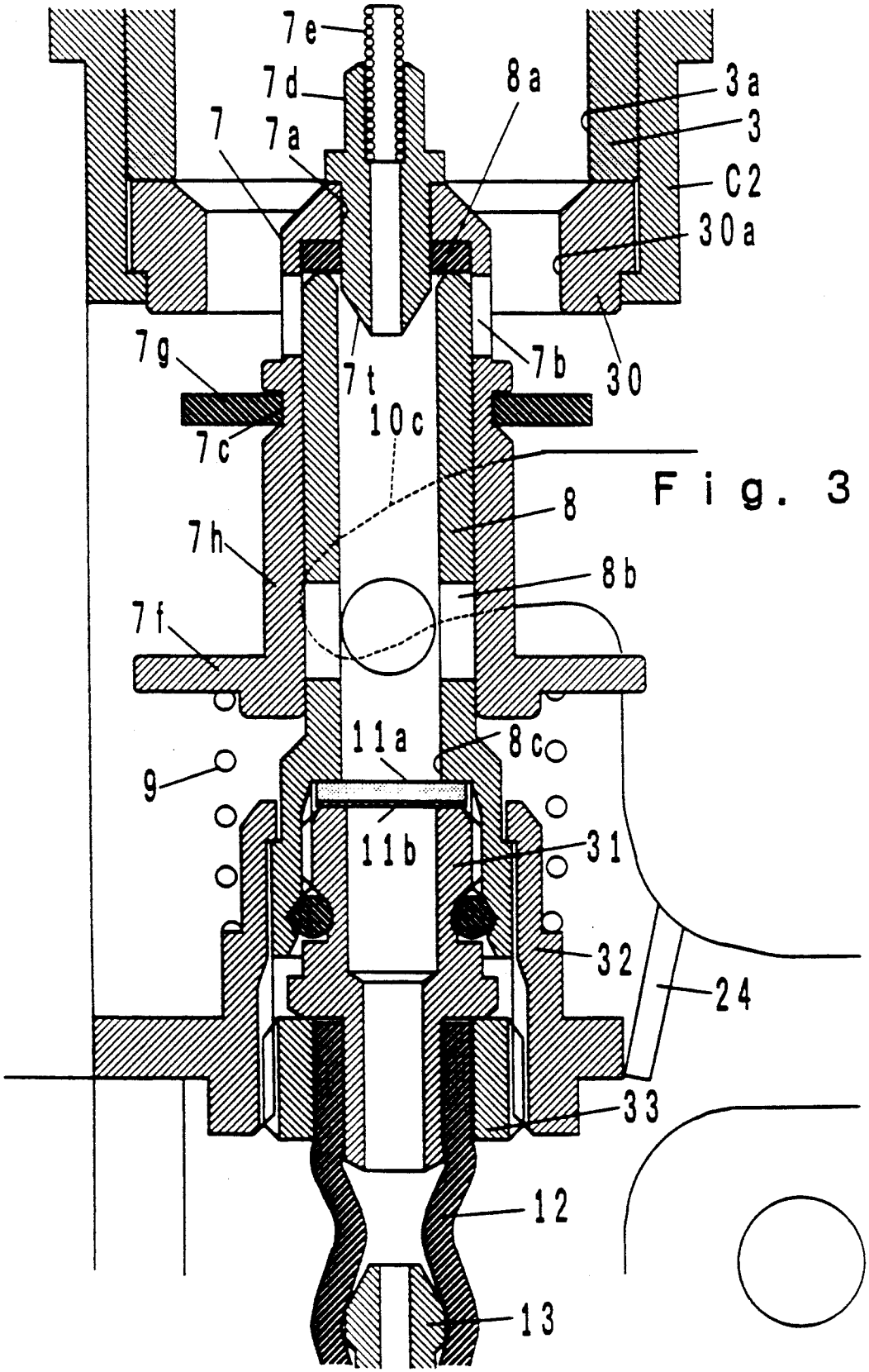
FIG. 3 is a cross section, to an enlarged scale, of part taken along the line 3A—3A shown in FIG. 2.
Figure 4:
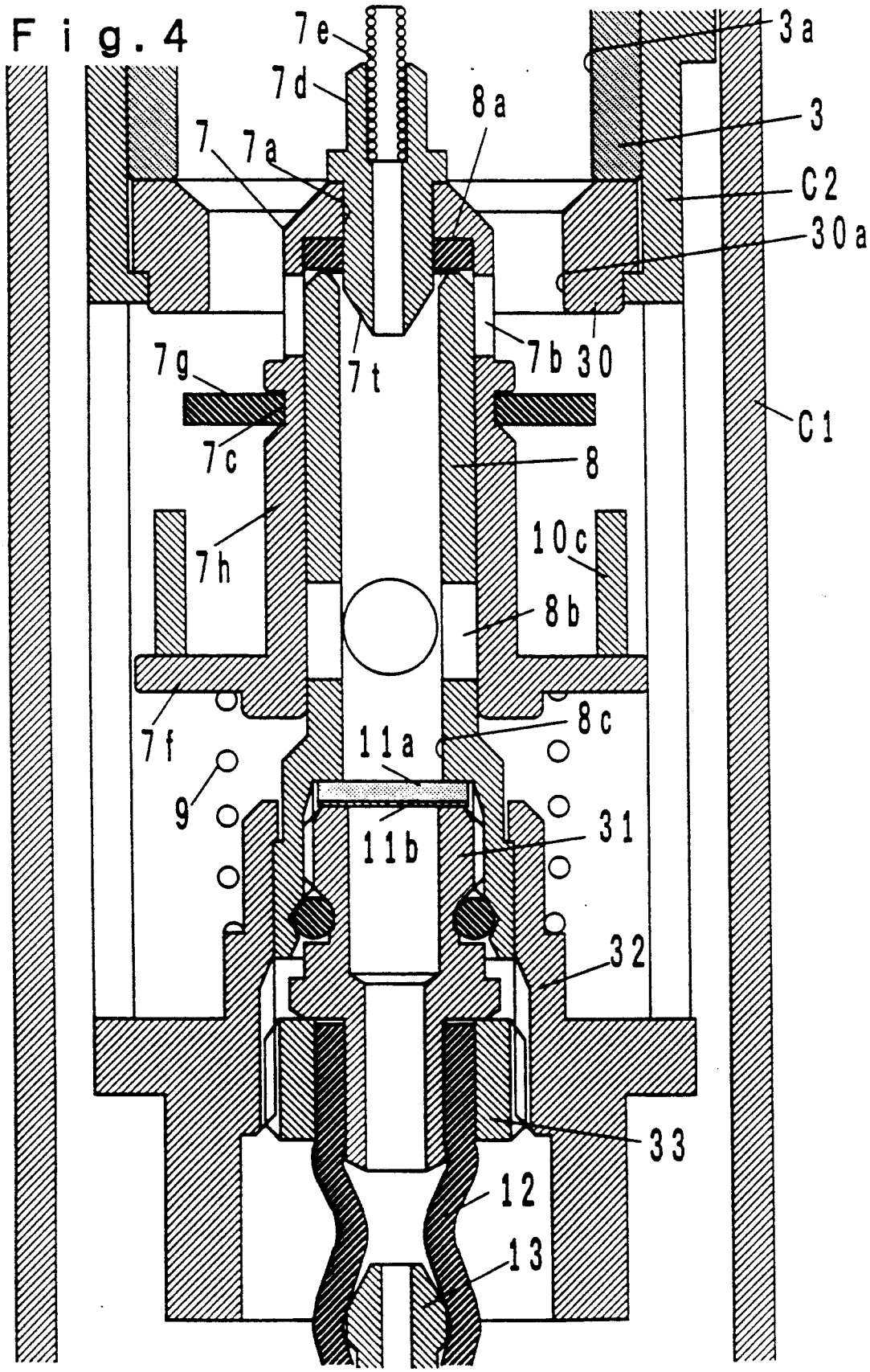
FIG. 4 is a cross section, to an enlarged scale, of part taken along the line 4A—4A shown in FIG. 1.

FIG. 1 shows one embodiment of the invention, and FIG. 2 is a cross section taken along the line 2A—2A shown in FIG. 1, and part of such cross section is shown to an enlarged scale in FIG. 4. FIG. 1 represents a cross section taken along the line 1A—1A shown in FIG. 2, and part of such cross section is shown to an enlarged scale in FIG. 3.

Initially referring to FIGS. 1 and 2, there is shown an embodiment of a cigarrette lighter having a casing which includes a body C1, an intermediate body C2 and a lid C3. The intermediate body C2 is formed with an opening for receiving a cylinder and which is formed with female threads. A ring 30 is inserted into the bottom of the opening, and a ceramic cylinder 3 is placed on top of the ring 30. Placed on the upper end face of the cylinder 3 is a support ring S having a catalyst wire 4 secured thereto. A ring-shaped nut 6 is threadably engaged with the female threads formed in the cylinder receiving opening of the intermediate body C2, whereby the nut 6 is effective to hold the ring S in place. Consequently, the ring 30, the ceramic cylinder 3, the support ring 5 and the retaining nut 6 are integrally assembled within the intermediate body C2. A free end of a flame switching sleeve 7 extends into the ring 30 and the ceramic cylinder 3.

Referring to FIGS. 3 and 4 also, the flame switching sleeve 7 is vertically slidable relative to a mixing tube 8 which is disposed internally therein, and is urged upwardly by a coiled compression spring 9. However, an arm 10*c* of a flame switching lever 10 acts against the resilience of the spring to hold an outer flange 7*f* of the flame switching sleeve 7 downwardly. The flame switching sleeve 7 has an opening 7*a* at its top end, in which a nozzle 7*d*is a press fit. A wire coil 7*e* is a press fit into an upper opening formed in the nozzle 7*d*. The lower end of the nozzle 7*d* extends into the mixing tube 8, with its lower end peripherally formed to define a downwardly pointed conical surface 7*t*. The flame switching sleeve 7 is formed with an opening 7*b* for discharging a fuel gas/air mixture, and has a closure plate 7*g* mounted at a location below the opening 7*b* for closing the lower opening 30*a* of the ring 30. The internal space within the flame switching sleeve 7 is defined as a cylindrical space in which the mixing tube 8 is a snug fit.

The mixing tube 8 is formed with an opening 8*a* at its top end, an air suction port 8*b* and a lower opening 8*c*, sequentially disposed as viewed from top to the bottom. Disposed in the lower opening 8*c* are a filter 11*a*, a nozzle plate 11*b* and a tube connecting sleeve 31, to the bottom of which the upper end of a tube 12, formed of a synthetic resin having a high stretchability, is connected by means of a ring nut 33. The mixing tube 8 extends through a cap nut 32, and the connection sleeve 31 is threadably engaged with the lower end of the mixing tube 8 while the ring nut 33 is threadably engaged with the lower end of the cap nut 32. The lower end of the tube 12 is connected to the free end of a fuel nozzle 13, which forms part of a fuel gas opening/closing mechanism 27 (see FIGS. 1 and 2) associated with a fuel tank FT. A gas discharge lever 14 (FIG. 1) is coupled to the fuel nozzle 13, and when the lever is driven for clockwise rotation, as viewed in FIG. 1, the fuel nozzle 13 is pulled upwardly, whereby a gas flow from the fuel nozzle 13 passes through the tube 12 into the mixing tube 8.

Figure 5:
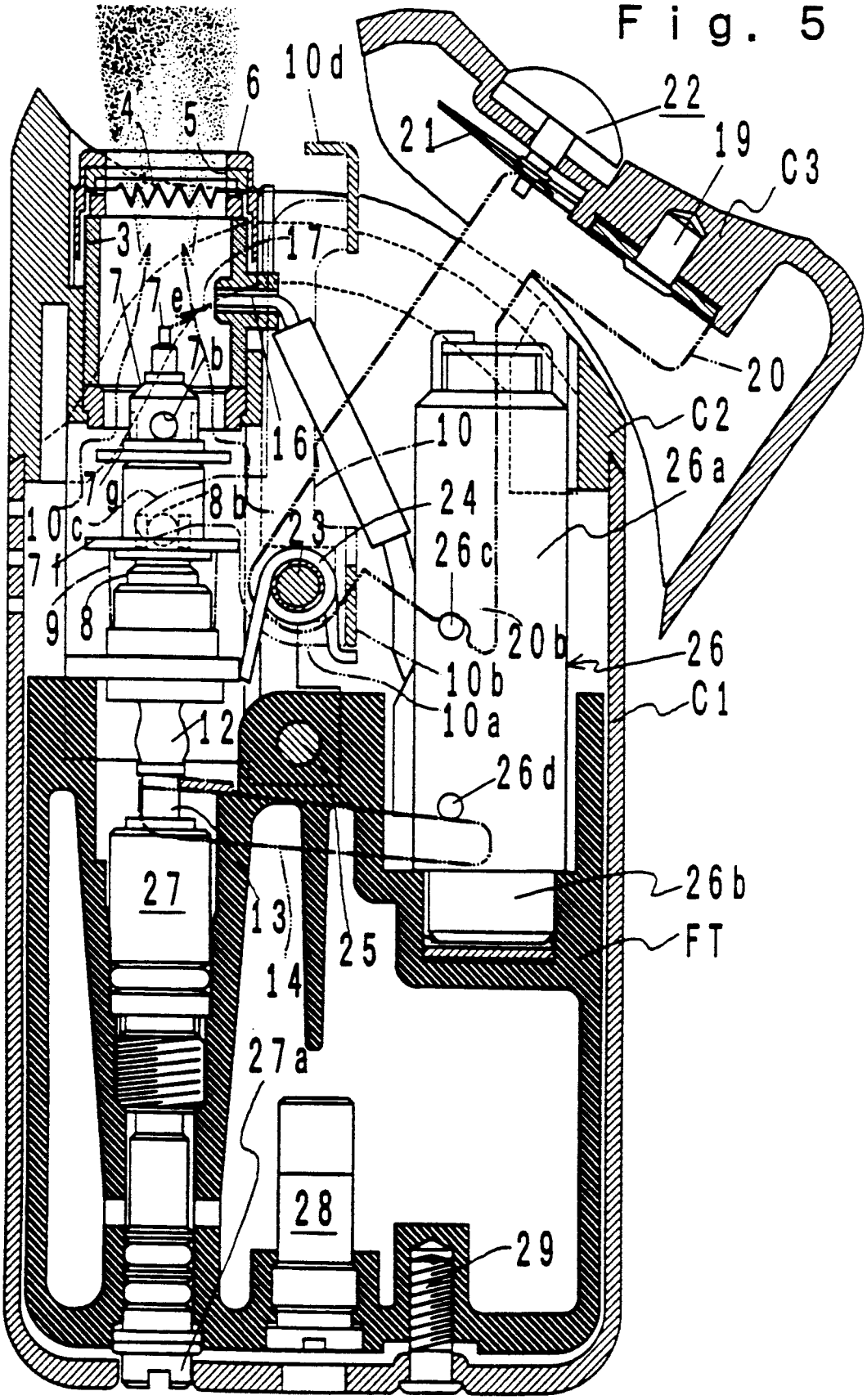
FIG. 5 is a longitudinal section similar to FIG. 1, illustrating the use of the lighter in a natural flame mode with a lid C3 open.

Returning to FIGS. 1 and 2, secured to the ceramic cylinder 3 is the free end of a high tension lead 16 of a piezoelectric ignition device 26, which also includes a ground electrode which is in turn electrically connected to the nozzle 7*d* and the wire coil 7*e* through a pin 26*c*, a lid support lever 20, a pin 23, a coiled spring 24, the cap nut 32, the mixing tube 8 and the flame switching sleeve 7. The electrical connection takes place through a mechanical contact, and if a poor contact occurs at any location in the described loop, a current flow loop is substantially formed as far as a high tension discharge is concerned. Thus, when the piezoelectric ignition device 26 is develops a high tension, it is applied across the nozzle 7*d* and the coil 7*e* of the flame switching sleeve 7 and the lead 16 to produce an electric spark 17 (FIG. 5) therebetween to ignite the fuel which is distributed therearound.

The intermediate body C2 supports, in addition to the ceramic cylinder 3, the cap nut 32 in a manner such that the mixing tube 8 is located centrally within the ceramic cylinder 3. Secured to the bottom surface of the lid C3 are a leaf spring 21 and the lid support lever 20 by disposing a capped pin 19 as a press fit therein. The shank of a selection button 22 in the form of a capped pin extends through the lid C3 from its top surface to the lower surface, and engages the leaf spring 21 below the bottom surface of the lid C3. As shown in FIG. 1, the leaf spring 21 acts to push up the selection button 22. The ceramic cylinder 3 and the cap nut 32 are mounted in the intermediate body C2 as shown in FIG. 1, and after engaging the gas release lever 14 with the fuel nozzle 13 and the fuel tank FT in the manner shown in FIG. 1, a pin 2S is inserted through pin openings formed in the fuel tank FT and in the lower limb of the intermediate body C2 to couple the intermediate body C2 with the fuel tank FT. The fuel tank FT includes a recess which receives a metal base 26*b* located at the bottom of an inner casing for the piezoelectric ignition device 26. The high tension lead 16 of the ignition device 26 is passed through a lead support opening formed in the ceramic cylinder 3, and the support lever 20 secured to the lid C3 is inserted into is the top opening of the intermediate body C2 from above so that a pin engaging limb 20*b* thereof is engaged with the pin 26*c* on the ignition device 26. A pin opening for the limb of the intermediate body C2, a pin opening formed in the bottom end of the flame switching lever 10 and the axis of the coiled spring 24 which is slightly compressed are aligned with each other, and the pin 24 is passed through all of these members. As shown in FIG. 1, the fuel tank FT, the intermediate body C2, the flame switching lever 10, the coiled spring 24 and the lid C3 are integrally connected together in a manner shown in FIG. 1, whereby one end of the coiled spring 24 abuts against a lateral flange (FIGS. 1, 3) of the cap nut 32 while its other end bears against an engaging projection 10*b* on the flame switching lever 10. The coiled spring 23 urges the flame switching lever 10 counter-clockwise to cause the arm 10*c* of the lever 10 to urge the upper surface of the external flange 7*f* of the flame switching sleeve 7 downwardly, thus urging the sleeve 7 downward as shown in FIGS. 1 to 4 to compress the coiled spring 9.

When the fuel tank FT having the intermediate body C2 and the lid C3 connected therewith is inserted into the top opening of the casing body C1, and a screw 19 is inserted into an opening formed in the bottom of the body C1 to be threadably engaged with a threaded opening formed in the bottom of the fuel tank FT, the assembly of the lighter shown in FIG. 1 is completed. In the assembled condition (FIG. 1), the trunk portion 7*h* of the flame switching sleeve 7 closes the air suction port 8*b*, as shown in FIGS. 3 and 4. The open/close plate 7*g* is located below the lower surface of the ring 30 to leave the bottom opening 30*a* open. Since the mixing tube 8 substantially closes the discharge port 7*b* for the gas mixture, any fuel gas that is delivered from the fuel nozzle 13 is passed through the nozzle 7*d* and the wire coil 7*e* into the internal space within the ceramic cylinder 3. Substantially no air is mixed with the fuel gas until the latter reaches the internal space in the ceramic cylinder 3. The flame switching lever 10 is pivotable about the pin 24, but is urged counter-clockwise by the resilience of the coiled spring, so that the flame switching sleeve 7 is urged downward to compress the coiled spring 9, as shown in FIG. 1. When the selection button 22 projects above as shown in FIG. 1, its lower end is located outside a circle of rotation depicted by the engaging projection 10*d* on the lever 10 about the pin 24, so that if the lid C3 is driven clockwise about the pin 24, the selection button 22 cannot abut against the engaging projection 10*d* of the lever 10, which therefore remains in its position shown in FIG. 1 (refer to FIGS. 1 and 5; natural flame mode).

Figure 6:
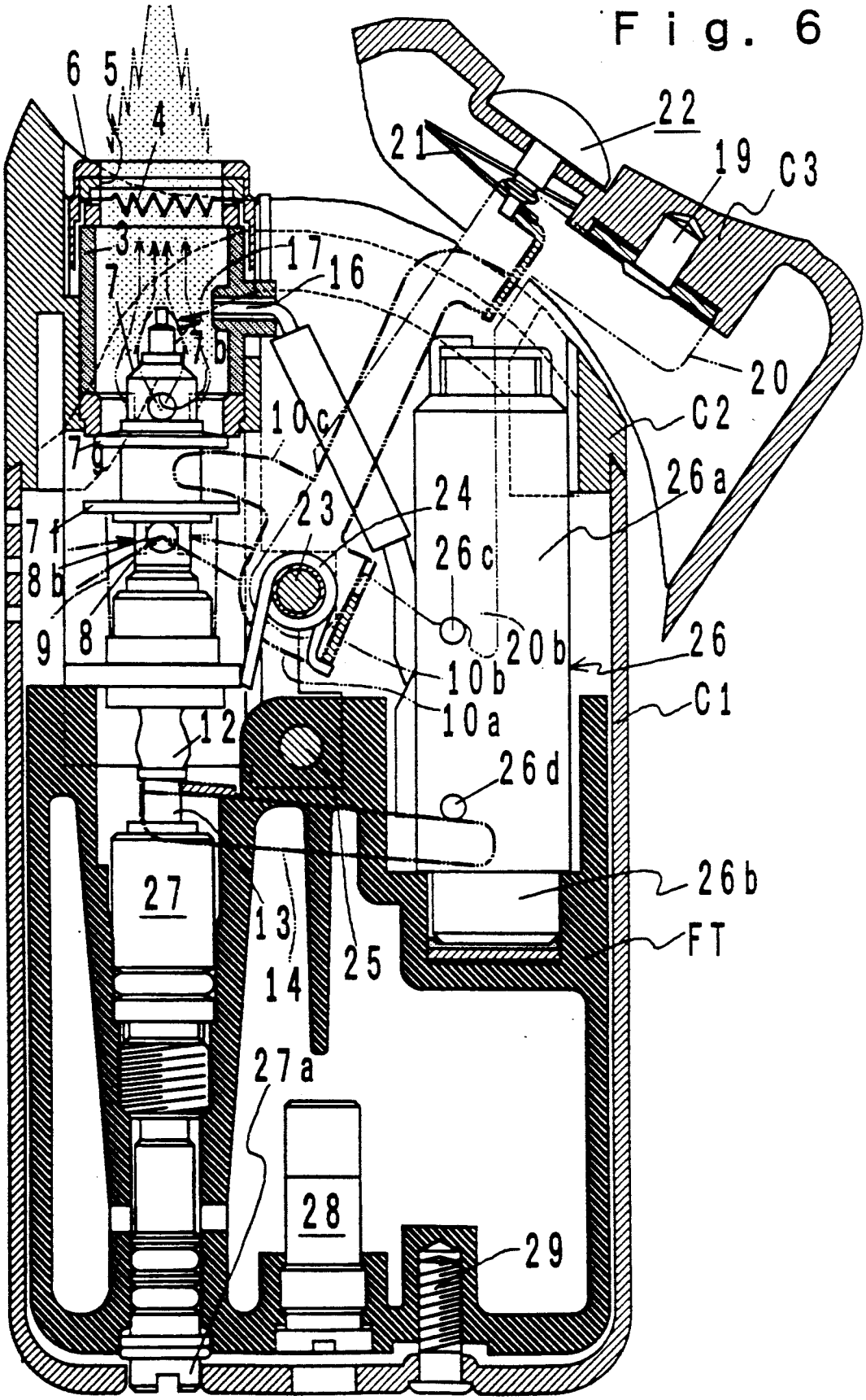
FIG. 6 is a longitudinal section similar to FIG. 1, illustrating the use of the lighter in a windshielded flame mode with the lid C3 open.
Figure 7:
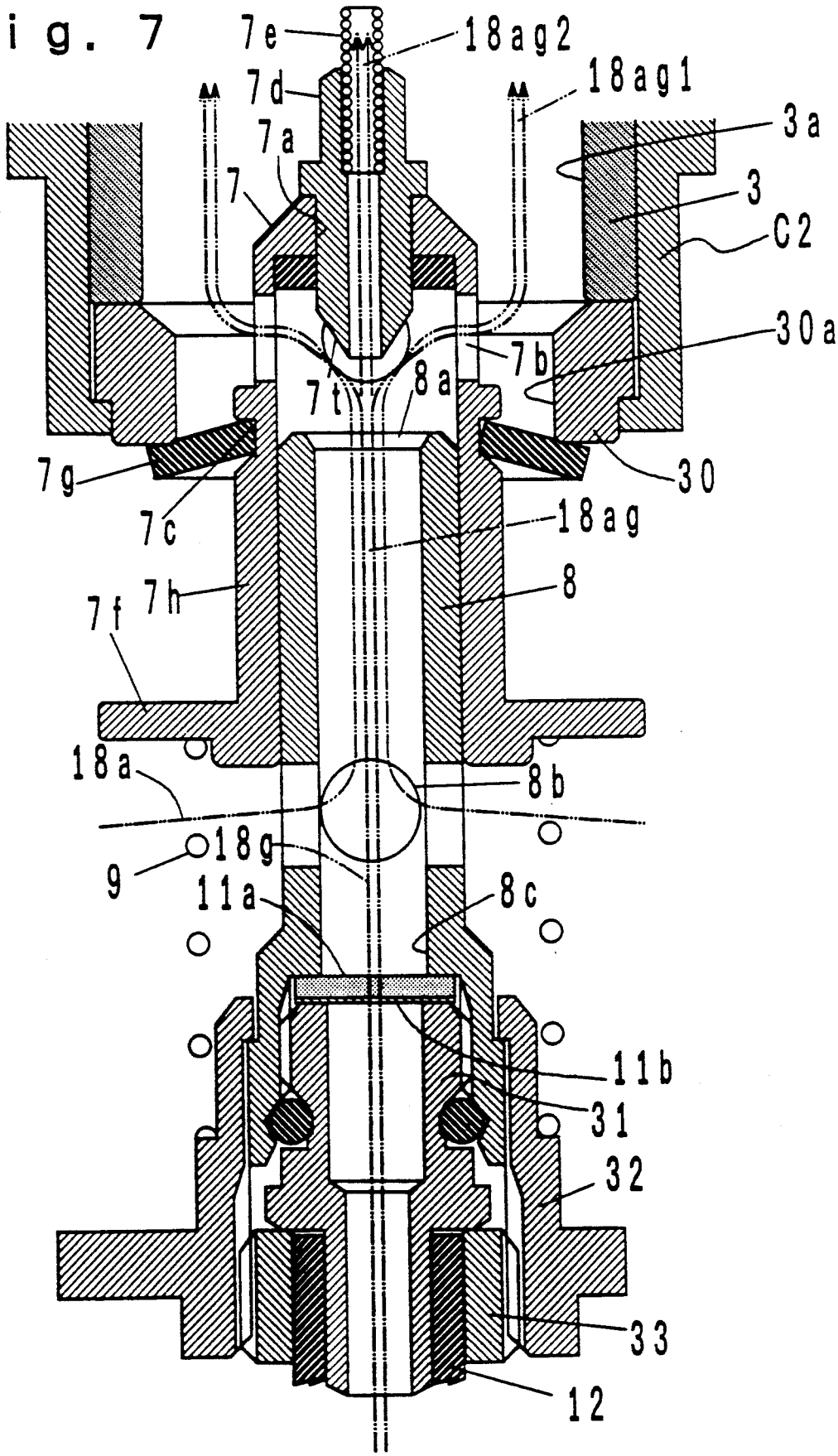
FIG. 7 is a longitudinal section, to an enlarged scale, of part of elements of a mechanism shown in FIG. 6.

However, when the selection button 22 is depressed and the lid C3 is rotated clockwise about the pin 24, the lower limb of the selection button 22 moves into the circle of rotation depicted by the engaging projection 10*d* of the lever 10 about the pin 24 and bears against the engaging projection 10*d* thereon, and the lever 10 is driven clockwise against the resilience of the coiled spring 23 to move the arm 10*c* of the lever 10 upward, whereupon the resilience of the coiled compression spring 9 is effective to push the flame switching sleeve 7 upward, moving the trunk portion 7*h* thereof to be displaced upward above the air suction port 8*b* to open it, as shown in FIGS. 6 and 7. The open/close ring 7*g* bears against the lower surface of the ring 30, whereby the lower opening 30*a* is closed, so that the discharge port 7*b* of the flame switching sleeve 7 for the gas mixture is displaced above the upper end of the mixing tube 8 to become open. Accordingly, any fuel gas delivered from the fuel nozzle 13 is mixed with air that is introduced into the mixing tube 8 through the opening 8*b* by virtue of suction effected by a negative pressure created by the fuel gas flow, and the fuel gas/air mixture is thus delivered into the internal space within the ceramic cylinder 3 by passing through the discharge port 7*b*, the nozzle 7*d* and the wire coil 7*e*. When reaching the internal space in the ceramic cylinder 3, the fuel gas is already mixed with an increased quantity of air (windshielded flame mode). The use and operation of the cigarrette gas lighter constructed in the manner mentioned above will now be described.

1. Natural Flame Mode (From FIG. 1 To FIGS. 5, 3)

When a user rotates the lid C3 clockwise by his thumb without contacting the selection button 22 while holding the body C1 and the intermediate body C2 of the casing with his index finger or middle finger, the clockwise rotation of the support lever 20 is transmitted through the pin 26*c* mounted on the outer casing 26*a* of the piezoelectric ignition device 26 to depress the outer casing 26*a*, whereupon a return spring, not shown, located within the device 26 is compressed as is a coiled spring, not shown, which is carried by a hammer plunger to apply an impact. During this process, a pin 26*d* on the outer casing 26*a* initially drives the gas discharge lever 14 clockwise to pull up the fuel nozzle 13, whereby the fuel gas flows into the mixing tube 8. Because the selection button 22 does not abut against the engaging projection 10*d* on the flame switching lever 10, the latter remains in its position shown in FIG. 1, and the mixing tube 8 and the flame switching sleeve 7 remain in their positions shown in FIGS. 1 and 3, so that the fuel gas from the fuel nozzle 13 passes through the nozzle *7d* and the wire coil *7e* into the internal space in the ceramic cylinder 3. By the time the fuel gas reaches the internal space in the ceramic cylinder 3, no substantial amount of air is mixed therewith. A flow of the fuel as ejected from the wire coil *7e* withdraws air through the lower opening 30*a* in the ring 30, thus causing an air stream to flow into the ceramic cylinder 3. Since the air stream flows into the ceramic cylinder 3 in a manner such that it surrounds the fuel gas, which is directed upwardly from the wire coil *7e*, from below. Accordingly, in the internal space within the ceramic cylinder 3, the concentration of the fuel gas is high while the air concentration is low as one moves toward the central axis, and on the contrary, the concentration of the fuel gas is low while the air concentration is high as one moves toward the free end of the high tension lead 16.

Slightly before the lid C3 reaches the position shown in FIG. S, a tapered cam mechanism, not shown, of the ignition device 26 releases a hammer plunger, whereupon the resilience of an impacting coil is effective to allow the hammer plunger to impact a piezoelectric element instantaneously, thus producing an electric spark 17 between the high tension lead 16 and the wire coil *7e*. A gas mixture is ignited where it is located on the path of the spark 17 or therearound and where a mixture ratio of the gas mixture is appropriate for the ignition. Thus, a flame rises upward from within the ceramic cylinder 3. It will be noted that there exists a point or location between the high tension lead 16 and the wire coil *7e* which has a concentration of burning gas which is appropriate for the ignition of the fuel gas. In this manner, the ignition of the fuel is assured in a reliable manner.

It will be seen that the flame which rises from the ceramic cylinder 3 looks very much like a candle light or a flame produced by rubbing a match, having a high concentration of fuel gas in its central portion where the deficiency of oxygen prevails (an inner flame) while a peripheral portion and a top portion of the flame where the concentration of oxygen is high presents a red, outer flame. Thus, a natural flame including a lower and inner portion which represents a bluish inner flame and an outer portion which represents a red outer flame rises from the ceramic cylinder 3. If a tip of a cigarrette is brought close to the flame, the cigarrette can be lit.

As is well recognized, such flame can be simply extinguished by wind, but the user can readily and visually recognize the ignition. For an outdoor use where there is no wind or for an indoor use, such red flame will be acceptable to a user in view of its emotional tranquilness created.

2. Windshielded Mode (FIGS. 6 and 7)

When a user depresses the selection button 22 and then rotates the lid C3 (FIG. 1) clockwise with his thumb, while holding the body C1 and the intermediate body C2 of the casing with his index finger, middle finger or the like of his right-hand, for example, the fuel gas will be delivered from the fuel nozzle 13 to produce the spark 17 FIG. 6) in the same manner as in the natural flame mode, but by the time the spark 17 is produced, the lower limb of the selection button 22 abuts against the engaging projection 10*d* on the flame switching lever 10 in the manner mentioned above, whereby the flame switching lever 10 is driven clockwise against the resilience of the coiled spring 23 to allow a fuel gas/air mixture to pass through the discharge port *7b*, the nozzle *7d* and the wire coil *7e* to reach the internal space within the ceramic cylinder 3. The fuel gas is already mixed with an increased quantity of air before it reaches the internal space (FIG. 7). Accordingly, upon occurrence of the spark 17, the gas mixture will be ignited at a location on the path of the spark 17 or therearound where the mixture ratio is appropriate for the ignition (see FIG. 6).

The gas mixture which is ejected upwardly through the nozzle *7d* produces an axial flow of the burning gas which projects above the mixing tube 8, shaping a flow of the burning gas within the mixing tube 8. If the axial flow is too strong, there results a high probability of failure of ignition by the spark 17, and if a mixture is successfully ignited, much of the gas mixture which is yet to be burned goes out of the mixing tube 8 to prevent a perfect combustion within the mixing tube 8, causing the likelihood of the flame being extinguished as by wind. In the present embodiment, the nozzle *7d* includes a peripheral, conical surface *7t* at its lower end which is tapered downwardly. Accordingly, the amount of gas mixture which flows into the nozzle *7d* is relatively small, assuring the ignition by the spark 17. Upon ignition, the internal space in the ceramic cylinder 3 will be occupied by the burning gas, which red heats the catalyst wire 4, causing the flame to be emitted at a high rate through the top opening 3*a*. The burning gas is either clear or slightly bluish, and when the tip of a cigarrette is brought close to, but spaced above the opening of the retainer nut 6, it can be lit. The retainer nut 6, the ceramic cylinder 3 and the ring 30 prevent an external wind from blowing the burning gas off, and thus the burning gas is stable or hardly extinguished by wind. Thus, there is provided a primary windshield effect. In addition, since the catalyst wire 4 is red heated by the burning gas, any temporary extinction of the combustion within the ceramic cylinder 3 as a result of a strong wind finding its way through the top opening of the retainer nut 6 is automatically compensated for by a re-ignition of the gas mixture distributed around the catalyst wire 4 which is heated. In this manner, the catalyst wire 4 which is red heated by the burning gas maintains a continued combustion of gas mixture which is distributed therearound, thereby producing a secondary windshield effect by the catalyst wire 4 in that any temporary extinction of the flame by a strong wind can be promptly compensated for by an automatic re-ignition.

What is claimed is:

1. A lighter including a fuel tank (FT) including a gas discharge valve, a cylinder member (3), a nozzle member (*7d*) which projects into an internal space of the cylinder member from below, a gas guide sleeve (8) for guiding a fuel gas which finds its way out of the fuel tank (FT) through the gas discharge valve thereof to the nozzle member (*7d*), an air suction port (8*b*) formed in the lateral surface of the gas guide sleeve (8), and ignition means for igniting a fuel gas which is led through the nozzle member (*7d*) into the cylinder member (3); characterized by an opening (30*a*) formed in the lower end of the cylinder member (3) for admitting an air into the cylinder member (3);

a first shutter member (*7h*) slidably mounted on the gas guide sleeve (8) and movable between a first position where it closes the air suction port (8*b*) and a second position where it opens the air suction port (8*b*);

and a second shutter member (7*g*) connected to the first shutter member (7*h*) and disposed for movement to a first position where it opens the opening (30*a*) when the first shutter member (7*h*) moves to its first position and to a second position where it closes the opening (30*a*) when the first shutter member (7*h*) moves to its second position.

2. A lighter according to claim 1, further including a spring member (9) for urging the first shutter member (7*h*) to one of the first and the second position, and a combustion mode switching lever (10) for driving the first shutter member (7*h*) to the other of the first and the second position against the resilience of the spring member.

3. A lighter according to claim 2, further including a casing (C1, C2, C3) including atop opening and a lid member (C3) which opens or closes the top opening, and a selector (22, 21) coupled to the lid member (C3) and movable to a position where it is engageable with the combustion mode switching lever (10).

4. A lighter according to claim 3 in which the selector (22, 21) comprises a button (22) including a limb which extends through the lid member (C3) from its top to its bottom surface and reciprocable in a direction substantially perpendicular to the top surface, and a leaf spring (21) coupled to the limb below the lower surface of the lid member (C3) for urging the button (22) in a direction to cause it to project above the top surface.

5. A lighter according to claim 3 in which the lid member (C3) is rotatable about a pin (23) extending in a direction perpendicular to a line parallel to the center axis of the gas guide sleeve (8), and in which the selector (22, 21) comprises a button (22) including a limb extending through the lid (C3) in a direction substantially perpendicular to the top surface thereof and movable between a retracted position located outside a circle of rotation of the top end of the combustion mode switching lever (10) about the pin (23) when the lid member (C3) is located to close the top opening of the casing (C1, C2, C3) and an engaging position located inside the circle of rotation, and a leaf spring (21) coupled to the limb below the lower surface of the lid member (C3) for urging the button (22) to the retracted position.

6. A lighter according to claim I in which the ignition means comprises a piezoelectric high tension generator including an electrode mounted on the cylinder member (3) in opposing relationship with the nozzle member (7*d*), the second shutter member (7*g*) being mounted on the lateral surface of the first shutter member (7*h*), the first shutter member (7*h*) comprising a lower opening through which the gas guide sleeve (8) is inserted, a top opening (7*a*) in which the nozzle member (7*d*) is a press fit, and a lateral opening (7*b*) formed in the lateral surface at a location between the top opening (7*a*) and the second shutter member (7*g*), the lateral opening (7*b*) being closed by the gas guide sleeve (8) when the first shutter member (7*h*) is located at its first position and being located above the top end of the gas guide sleeve (8) to provide a communication between the gas guide sleeve (8) and the internal space within the cylinder member (3) when the first shutter member (7*h*) is located at its second position.

7. A lighter according to claim 6 in which the nozzle member (7*d*) includes a downwardly pointed peripheral conical surface (7*t*) which projects into the top opening of the gas guide sleeve (8) when the first shutter member (7*h*) assumes its first position and which is located above the top opening of the gas guide sleeve (8) when the first shutter member (7*h*) assumes its second position.

8. A lighter according to claim 7 in which the nozzle member (7*d*) includes a wire coil (7*e*) which is disposed as a press fit in the top opening thereof and which projects above the top opening.

* * * * *